United States Patent [19]

Bentvelzen et al.

[11] 4,216,054

[45] Aug. 5, 1980

[54] LOW-CONSISTENCY OZONE DELIGNIFICATION

[75] Inventors: Jozef M. Bentvelzen; Steven L. Bogart, both of Everett; Maharaj K. Gupta, Renton; William T. McKean, Lynnwood; Michael D. Meredith, Snohomish; Louis O. Torregrossa, Puyallup, all of Wash.

[73] Assignee: Weyerhaeuser Company, Tacoma, Wash.

[21] Appl. No.: 836,449

[22] Filed: Sep. 26, 1977

[51] Int. Cl.[2] ..... D21C 9/10

[52] U.S. Cl. ..... 162/57; 8/111; 162/65

[58] Field of Search ..... 162/57, 65, 90; 68/181 R; 8/109, 111

[56] References Cited

U.S. PATENT DOCUMENTS

| | | | |
|---|---|---|---|
| 396,325 | 1/1889 | Brin et al. | 162/65 |
| 1,957,973 | 5/1934 | Campbell | 8/109 X |
| 2,438,100 | 3/1948 | Whitner | 8/111 |
| 2,466,633 | 4/1949 | Brabender | 162/65 |
| 3,318,657 | 5/1967 | Wade | 162/65 X |
| 3,451,888 | 6/1969 | Ancelle | 162/65 |
| 3,451,888 | 6/1969 | Ancelle et al. | 162/65 |
| 3,663,357 | 5/1972 | Liebergott | 162/65 |
| 3,832,276 | 8/1974 | Roymoulik et al. | 162/65 |
| 3,966,542 | 6/1976 | Oldshue | 162/57 |
| 4,036,681 | 7/1977 | Holton | 162/90 |
| 4,080,249 | 3/1978 | Kempf et al. | 162/57 |

FOREIGN PATENT DOCUMENTS

| | | | |
|---|---|---|---|
| 769631 | 10/1967 | Canada . | |
| 902861 | 6/1972 | Canada . | |
| 966604 | 4/1975 | Canada . | |
| 970111 | 7/1975 | Canada . | |
| 1298875 | 7/1969 | Fed. Rep. of Germany . | |
| 2327407 | 12/1973 | Fed. Rep. of Germany . | |
| 2444475 | 4/1975 | Fed. Rep. of Germany . | |
| 432552 | 12/1911 | France . | |
| 1441787 | 5/1966 | France . | |
| 16085 | of 1913 | United Kingdom . | |
| 6677 | of 1915 | United Kingdom . | |
| 185421 | 8/1922 | United Kingdom . | |
| 1274615 | 5/1972 | United Kingdom . | |
| 518544 | 7/1976 | U.S.S.R. | 162/65 |

OTHER PUBLICATIONS

Cunningham et al., "The Action of Ozone on Cellulose", J. of Chem. Society, vol. 101 (1912), pp. 497–512, vol. 103, pp. 677–686 (1913).

Duree et al., "The Action of Ozone on Cellulose and Modified Cellulose", J. of the Textile Inst., (1938).

Pancirolli, Indi Carta (Milan), "Sulfate Pulp Bleaching Tests with Ozone", 3–1953, pp. 35–38.

Samuelson et al., "A Comparison Between the Degradation of Cotton and Wood Pulp", Svensk Papperstidning, 10/1953, pp. 779–784.

Schuerch, "Ozonization of Cellulose and Wood", Journal of Polymer Science: Part C, No. 2, 1963, pp. 79–95.

Katai et al., "Mechanism of Ozone Attack on α-Methyl Glucoside and Cellulosic Materials", J. of Polymer Science, 1966, pp. 2683–2703.

Moore et al., "The Resistance of Hemicelluloses in Wood Fiber to Degradation By Ozone", TAPPI, 1966, pp. 206–209.

Encyclopedia of Chemical Technology, vol. 14, pp. 412–414, 1967, "Ozone".

Soteland et al., "The Effect of Ozone on Some Properties of High Yield Pulps", Norsk Skogindustri, 2/1968, pp. 46–52.

"The Effect of Ozone on Some Properties of Groundwoods of Four Species, Part I; Soteland, Norsk Skogindustri, 3/1971, pp. 61–66.

Secrist et al., "Kraft Pulp Bleaching–II; Studies on the Ozonation of Chem Pulps", TAPPI 4/1971, pp. 581–584.

Liebergelt, "Sequential Treatment of Mechanical Pulps at High Consistency with $H_2O_2$ & $O_3$, " Pulp & Paper Mag of Canada, 9/1972, pp. 70–73.

Soteland, "Bleaching of Chemical Pulps with Oxygen & $O_3$", Preprint, Vancouver Bleach. Conf., 1973, pp. 117–120.

Soteland, "Bleaching of Chem. Pulps with Oxygen and Ozone", Pulp & Paper Magazine of Can., 4–1974, pp. 91–96.

Buley, "Potential $O_2$ Application in Pulp & Paper Ind.", TAPPI, 7–1973, pp. 101–104.

Soteland, "The Effect of $O_3$ on Some Properties of T-M Pulps", Norsk Skogirdustri, 10/1973, pp. 274–277.
Soteland et al., "The Effect of Ozone on Mech. Pulps", Norsk Skogindustri, 6–1974, pp. 165–169.
Kamislima et al., "$O_3$ Bleaching of Kraft Pulp: The Bleachability of the Pulps of Softwood & Hardwood", 19th Japanese Symposium on the Lignin Chemistry, 1974, pp. 73–76.
Grigorescu, "Oxygen Bleaching of Fibrous Pulps", Celluloza Si Hirtie, 23, (2), 1974, pp. 58–62.
"Potential Possibilities of Ozone", Paper, World Research & Development Number, 1975, pp. 56–67, 60–61.
Rothenburg et al., "Bleaching of $O_2$ Pulps with $O_3$", TAPPI, 8/1975, pp. 182–185.
Schuerch, "Ozonizaton of Cellulose and Wood", Journal of Polymer Science, No. 2, pp. 79–95 (1963).
Soteland, "The Effect of Ozone on Some Properties of Groundwoods of Four Species, Part, I, Norsk Skogindustri (1968).
Osawa et al., "The Action of Gaseous Reagents on Cellulosic Materials 11, Pulping of Wood with Ozone", TAPPI, vol. 46, No. 2 (2–1963).
Procter, "Ozone Gas Treatments of High Kappa Kraft--Pulps", Pulp & Paper Magazine of Canada, vol. 75, No. 6, (6–1974).

*Primary Examiner*—S. Leon Bashore
*Assistant Examiner*—Steve Alvo

[57] ABSTRACT

A slurry of cellulosic fiber and water having a consistency in the range of 0.017–4.9% of the total ungassed weight of fiber and water is bleached with ozone. This is done without the usual addition of organic additives. The water can include impurities created by the bleaching process. Rapid reaction times under 8 minutes and preferably under 5 minutes are achieved.

The reaction is enhanced in the consistency range of about 0.017–0.7%.

The slurry is mixed using a mixing energy of 0.002–1.0 horsepower per cubic foot of gassed slurry. The mixing energy will determine whether the gas-liquid or liquid-solid interface will limit the speed of the reactions. The passage of ozone from the gas to a liquid phase will be the limiting factor below about 0.2 horsepower per cubic foot of gassed slurry. The increasing presence of ozone in the liquid as the horsepower increases from about 0.2 to about 0.4 horsepower per cubic foot of gassed slurry indicates this is a zone in which both the gas-liquid and the liquid-solid interface are limiting factors. Above about 0.4 horsepower per cubic foot of gassed slurry the liquid-solid interface will be the limiting factor.

Superficial velocity of the ozone bearing gas is in a range of 200–3800 feet per hour. The ozone usually is 0.05–6% by weight of the total weight of the gas.

49 Claims, 1 Drawing Figure

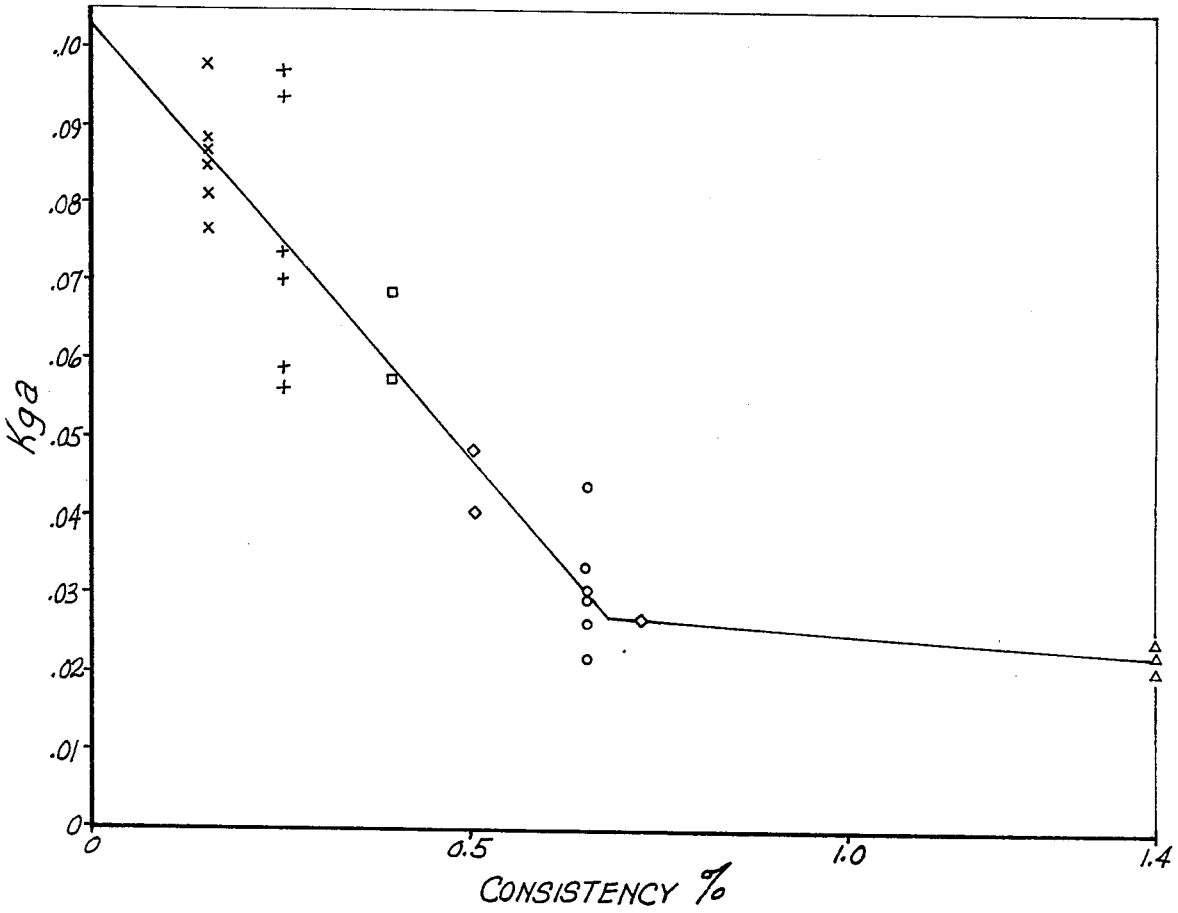
.10
.09
.08
.07
.06
.05
.04
.03
.02
.01
0
Kga
0
0.5
1.0
1.4
CONSISTENCY %

LOW-CONSISTENCY OZONE DELIGNIFICATION

BACKGROUND OF THE INVENTION

1. Field of the Invention

The treatment of cellulosic fiber with ozone.

2. Prior Art

Historically, the treatment of wood chips to form a white fiber has been divided into two processes, pulping and bleaching. Recently the distinction between these processes has become less distinct and the words have become more terms of art than a description of a chemical process. To provide a background for this invention, the two processes will be defined and distinguished. The present definitions are based upon the definitions provided in a number of pulping and bleaching textbooks and monographs.

Pulping is the changing of wood chips or other wood particulate matter to fibrous form. Chemical pulping requires cooking of the chips in solution with a chemical and includes partial removal of the coloring matter such as lignin associated with the wood.

Bleaching is the treatment of cellulosic fibers to remove or alter the coloring matter associated with the fibers to allow the fiber to reflect white light more truly.

Attempts to bleach cellulosic fiber with ozone, actually air or oxygen containing some ozone, have occurred since late 1800s. Many conditions have been tried and from these there has evolved a theory, substantiated by experiments, as to the best conditions for the ozonization of cellulose.

The principal work has been done by Doree with Cunningham in 1912 and 1913 and with Healey in 1938; Brabender et al in 1949; Osawa and Schuerch et al of Syracuse University in the 1960s; Liebergott et al of the Pulp and Paper Research Institute of Canada in the 1960s and 1970s; and Soteland et al of the Norwegian Pulp Research Institute in the 1960s and early 1970s.

The references describing this work are: Cunningham and Doree, "The Action of Ozone on Cellulose," Part I, Cotton and Part II, Jute, *The Journal of the Chemical Society,* Vol. 101 (1912), pp. 497–512, and Part III, Beechwood, *The Journal of the Chemical Society,* Vol. 103 (1913), pp. 677–686; Doree and Healey, "The Action of Ozone on Cellulose and Modified Cellulose," *The Journal of the Textile Institute,* March 1938, pp. T27-T42; Brabender et al, U.S. Pat. No. 2,466,633, 1949, "Method of Bleaching Cellulosic Pulp"; Pancirolli, "Sulphate Pulp Bleaching Tests With Ozone," Indi Carta (Milan), March 1953, pp. 35–38; Osawa and Schuerch, "The Action of Gaseous Reagents on Cellulosic Materials, Part I," TAPPI (1963), Vol. 46, No. 2, pp. 79–84; Schuerch "Ozonization of Cellulose and Wood," *Journal of Polymer Science,* Part C, No. 2, 1963, pp. 79–95; Soteland (I), "The Effect of Ozone on Some Properties of Groundwood of Four Species, Part I," *Norsk Skogindustri,* March 1971, pp. 61–66; Secrist and Singh, "Kraft Pulp Bleaching II: Studies on the Ozonation of Chemical Pulps," TAPPI, Vol. 54, No. 4, April 1971, pp. 581–584; Liebergott "Paprizone Process for Brightening and Strengthening Groundwood," *Paper Trade Journal,* Aug. 2, 1971, pp. 28–29; Soteland (II) "Bleaching of Chemical Pulps with Oxygen and Ozone," *Pulp andd Paper Magazine of Canada,* Vol. 75, No. 4, April 1974, pp. 91–96; and Procter, "Ozone gas treatments of high Kappa kraft pulps," *Pulp and Paper Magazine of Canada,* Vol. 75, No. 8, June 1974, pp. 58–62.

From these publications a consensus can be seen. High consistencies are required to treat cellulosic fiber, either cotton or wood pulp, with ozone. The exact percentages may differ slightly, but the message that high consistencies are required is emphatic. There is some slight confusion because the figures are either in terms of moisture content—amount of water on the fiber—or consistency—amount of fiber in the water. The Doree articles indicate that cotton requires a 50% moisture content for good ozonization. Procter indicates this is the same as 67% consistency. Brabender states that for wood fibers 25 to 55% consistency is required. This was later amended by Osawa and Schuerch to 30 to 45% consistency—230 to 120% moisture content. Osawa and Schuerch then used 100% moisture content for a number of experiments. Liebergott, treating mechanical pulp in which the chemical reaction with ozone appears to be different from the reaction with chemical pulp, used consistencies of 15 to 60%. Secrist and Singh tried the consistencies of 40 to 80%, preferring 60%. Procter notes that 30 to 40% consistency with wood pulp fibers is best.

Only a few have attempted to ozonate at low consistencies. The results are not considered successful, and the experimenters returned to higher consistencies as a matter of standard practice.

Three articles discuss work at low consistency.

Soteland treated pulp in a 90% by volume acetone solution at a 0.5% consistency. He indicates that pulp at low consistency can only be treated in an organic solution.

Pancirolli attempted ozonization of sulphate pulp at 2% consistency. It required three treatments of five hours each for a total of 15 hours.

Schuerch amplifies a statement made in the Osawa and Schuerch article about low-consistency work, and states that ozonization was carried out at consistencies of 0.1% and 1%. FIG. 4 of Schuerch indicates that at 0.1% consistency, the brightness, initially 30, increased to between 50 and 60 in ten minutes, between 75 and 80 in one-half hour, and around 81 or 82 in one hour. However, at 1% consistency the brightness increased to 60 in one hour and required three hours to finally reach 80, even with "vigorous stirring." From this he concluded that one had to use organic substances or higher consistencies to get good reaction with ozone.

These comments were echoed by Liebergott, Soteland and Procter in their work and articles. It was considered by all to be impossible to obtain quick, good reactions with ozone at low consistencies.

A recent patent, Oldshue U.S. Pat. No. 2,966,542 issued June 29, 1976, describes a multi-stage chlorination system but indicates that the system can be used for ozone. This patent stages that reaction time is independent for power level after a certain threshold power level has been reached.

Oldshue specifies, in line 9 of column 7, a consistency of 3.5%. His power levels, in the table at the bottom of column 6, are 20 to 60 horsepower per 100 gallons, equivalent to 1.5 to 4.5 horsepower per cubic foot.

While none of the prior art describes an ozone treatment in a low-consistency water solution in conjunction with other treatments, a number of the articles describe high-consistency ozone treatments in conjunction with other pulp treatments. Four of these appear to be pertinent. These are Secrist and Singh, supra; Soteland (II), supra; Singh Canadian Patent No. 966,604, 1975, "Kraft Pulp Bleaching and Recovery Process"; and Rothenburg et al "Bleaching of Oxygen Pulps with Ozone," TAPPI, Vol. 58, No. 8, August 1975, pp. 182–185.

Secrist and Singh mention an $O_3$DED sequence—ozone, chlorine dioxide, sodium hydroxide extraction, chlorine dioxide.

Soteland (II) mentions a number of sequences. These include ozone-peroxide, ozone-hypochlorite, ozone-ozone, oxygen-ozone, oxygen-ozone-peroxide, oxygen-ozone-hypochlorite, oxygen-ozone-ozone-peroxide, and oxygen-ozone-ozone-hypochlorite. Soteland treats his pulp with sulfur dioxide and EDTA prior to the ozone treatment.

Singh mentions kraft-ozone-sodium hydroxide extraction-peroxide. The ozone may be in one, two, or three stages with an optional washing between the ozone stages.

Rothenburg describes oxygen-ozone, oxygen-ozone-sodium hydroxide extraction-ozone, oxygen-ozone-peroxide, oxygen-ozone-acetic acid, and kraft-ozone-sodium hydroxide extraction-ozone.

Again it should be emphasized that these ozone treatments were high-consistency treatments, and the use of high-consistency treatments created another problem, erratic results and poor strength properties.

The strength properties are mentioned in a number of patents and articles.

Pancirolli notes on page 8:

"Tests demonstrated that sulphate pulp can be bleached with ozone alone but with a notable reduction of the final pulp viscosity, in physical and mechanical properties as well as in the yield."

This is also illustrated in a table in which the viscosity of ozone-bleached pulp is 15 and 21 centipoises compared to a viscosity of 50 centipoises for pulp bleached with chlorine and hypochlorite. In a comparison of the ozone-bleached pulp with the chlorine/hypochlorite-bleached pulp at the same brightness, the breaking length, the burst, and the fold of the ozone-treated pulp were less than those of the chlorine/hypochlorite-bleached pulp.

Katai and Schuerch, on page 2695 of their article "Mechanism of Ozone Attack on Alpha Methyl Glucoside and Cellulosic Materials" in the *Journal of Polymer Science,* Part A 1, Vol. 4, pp. 2683–2703 (1966), show that the viscosity decreases greatly as the brightness of the pulp increases when being treated with ozone.

Although the strength properties of groundwood pulps are usually increased by ozone treatment because of the modification of both the lignin and the surface of the fibers, allowing better bonding, chemical pulps do not appear to react in the same manner.

Secrist and Singh tested Canadian hardwoods. Although Table 1 and Table 2 appear to show no difference in tear between the control and ozone-treated samples, Table 4–6 appear to show that the kraft $O_3$DED sequences have a lower tear than the kraft CEDED sequences. On page 583 it is stated:

"Tearing strength of the ozonated pulp was 10% lower than conventional fiber at both reported freeness levels. The same relationships was apparent when the pulps were compared at constant breaking length levels of 7,500 and 11,500. The interrelationship of fiber bonding with tearing energy may explain these observations."

The article also indicates there is no relationship between viscosity drop and strength.

The Soteland (II) article states that ozone is more a delignifying agent than a bleaching agent. In the first paragraph on page 93 he notes:

"It is evident that bleaching methods based on oxygen, ozone, and peroxide produce pulps with viscosity values far below what is common for conventional pulps.

"Secrist and Singh have shown, however, that even if the viscosity is drastically reduced by an ozone treatment, the strength properties of the kraft pulp were not seriously affected. The tear factor of this eucalypt kraft pulp has been substantially reduced by this bleaching treatment. The drop in tear factor is too serious for this particular pulp for an acceptance of the oxygen-ozone bleaching process as presented here. However, it has to be stressed that this oxygen-ozone bleaching process is still in its stage of birth and improvement are to be expected."

He also worked with sodium bisulfite pulp from spruce and found the strength properties more satisfactory. The tear factor was reduced but the decrease was rather small, and therefore not prohibitive for the acceptance of these bleaching methods for sulfite pulps. He obtained the same viscosity of around 700 cubic centimeters per gram, using two-stage ozone, ozone plus peroxide, or oxygen plus ozone.

Procter in FIG. 1 shows that ozone treatment reduces tear. Tear is low at 30% consistency, but higher at 15consistency, the lowest consistency shown. Procter states that these sheet properties corresponding to carbohydrate reactions are most significantly altered when ozonizations are carried out at between 30 and 35% consistency where burst, strength, tensile and density are at a maximum and tear factor is at a minimum.

Kamaslimi et al, "Ozone bleaching of Kraft Pulp," 19th Japanese Symposium on the Lignin Chemistry, 1974, shows in FIG. 7 that tear, burst, and breaking length decrease as the ozone supply increases.

Rothenburg et al seems to indicate that results using high-consistency ozone bleaching are not consistent.

SUMMARY OF THE INVENTION

Although ozone has been investigated as a bleaching chemical for over 70 years, it has not been used commercially because of the problems associated with its use. The literature states that it is difficult, if not impossible, to bleach pulp with ozone at low pulp consistencies. High-consistency systems are difficult to operate, so the product from a high-consistency system is not uniform or consistently the same. However, oxygen and ozone appear to be more environmentally sound that chlorine-based bleaching chemicals and ways must be found to use them.

The inventors, in attempting to understand the difficulty with low-consistency pulp systems, discovered to their surprise that it was possible to get good bleaching with ozone at low consistencies if there was good mixing of the pulp with the ozone. They discovered that there was a definite break in the trend of the mass transfer coefficient of ozone at a pulp consistency of 0.68 to 0.7%. They confirmed earlier work which indicated that, of the factors controlling the rate at which ozone is transferred from a gas to a solid in a gas-liquid-solid system, two predominate. The first of these factors is the transfer from the gas phase to a liquid phase, and the second is the transfer from the liquid phase to the solid phase. In this instance, the first is the transfer of the ozone through the boundary layer between the bubble and the slurry liquid and the second is the transfer of the ozone through the boundary layer between the slurry liquid and the fiber.

They discovered that the limiting boundary layer will depend on the mixing energy, the specific horsepower being dissipated into the gassed slurry. The passage of ozone from the gas phase to the liquid phase will be the limiting factor below a mixing energy of about 0.2 horsepower per cubic foot of gassed slurry. The increasing presence of ozone in the liquid as the horsepower increases from about 0.2 to about 0.4 horsepower per cubic foot of gassed slurry indicates that this is a limitation zone in which both the gas-liquid interface and the liquid-solid interface are limiting factors. Above 0.4 horsepower per cubic foot of gassed slurry, the limiting factor is the liquid-fiber interface. This relationship would hold for low-consistency pulps and specifically pulps having consistencies of less than 5%. The experiment data was taken for pulp consistencies up to 1.4% and extrapolated to about 5%. The relationship is especially true within the range of pulp consistencies from 0.017 to 0.77.

They also discovered that the transfer increased at superficial velocites of the ozone bearing gas above 200 feet per hour. Experiments were performed up to the limit of the experimental equipment, 1,400 feet per hour. There appeared to be no upward limit, although the type of reactor changes at higher velocites. The power requirement would become excessive at higher velocities, and 3,800 feet per hour appears maximum because of this.

Using the experimental results, the range of reaction conditions were calculated. The consistency is 0.017 to about 0.7%, the optimum being at 0.18% creating an optimum range of 0.15 to about 0.7%. This consistency is the weight of the fiber in the fiber-water slurry and is based on the fiber and water only; i.e., the ungassed slurry. The horsepower to the gassed slurry is 0.002 to 0.42 horsepower per cubic foot of gassed slurry, and preferably 0.002 to 0.2 horsepower per cubic foot of gassed slurry. The superficial velocity of the ozone bearing gas is at least 200 feet per hour, and may be as high as 3,800 feet per hour. Only horsepower or superficial velocity need be within the stated range. The amount of ozone charged to the material should be in the range of 0.5 to 5% of the weight of the oven dry fiber. The ozone is in a carrier gas which usually is oxygen. The ozone would be 0.05–6% by weight of the total weight of the mixture when it is produced by normal methods. However the concentration of ozone in the carrier gas can be greater. High concentrations of ozone should be avoided since ozone becomes explosive in concentrations above 23% by weight.

As many as 25 stages of ozone treatment may be used.

This system now makes the commercial use of ozone feasible because the system may be operated and a uniform product may be obtained. It is also possible to provide a closed or partially closed mill in which the resultant by-products or effluent have better environmental characteristics than those created by chlorine-based chemicals.

The inventors have found that the usual statements in the prior art about the consistency required for an ozone reaction are not necessarily correct, and the problems associated with the prior art consistencies and processes are eliminated by going against the teachings of the prior art. It appears, in retrospect, that the prior art investigators did not understand that nature of the system and were observing and measuring phenomena that were not limiting and, therefore, reached incorrect conclusions as to the factors that determined the reaction rate and the parameters within which the reaction was operable.

The starting material for the ozone bleach is a chemical pulp and a number of sequences starting with sulfate or kraft, sulfite, or soda pulping have been devised. The pulping may be with or without additives. It is preferred that the pulping step be followed by an oxygen bleach which may be either low, below 6%; medium, between 6 and 15%; or high, above 15%, consistency. The oxygen bleach may be in one or more stages and it is possible in a multi-stage process to use both low- and high-consistency oxygen bleach. The Kappa of the pulp should be below 16 after the oxygen bleach and 1–5 after the ozone bleach. Following the ozone bleach there may be a final bleach sequence such as chlorine dioxide, hydrogen peroxide, a chlorine dioxide-sodium hydroxide extraction-chloride dioxide sequence or a sodium hydroxide extraction followed by a second low-consistency ozone treatment. Both the oxygen and ozone treatments may be a number of stages.

Since ozone has been used to treat various types of mechanical pulp (groundwood, refiner and thermomechanical), it is believed that the low-consistency ozone treatment could also be used for these materials.

The present experiments were on fir, one of the more difficult woods to bleach. From these experiments it may be inferred that the present system may be used with the softwoods and hardwoods standardly used for pulp. Typical woods used for pulping are listed in Rydholm "Pulping Processes" Interscience Publishers, 1965.

A general method of adjusting the mass transfer of a gaseous chemical in a softwood chemical wood pulp slurry has also been discovered. The superficial gas velocity, $V_s$, should be maintained in the range 100–1,400 feet per hour, and the mixing energy, Pg/V, to the gassed slurry should be maintained in the range of 0.006 to 0.1 horsepower per cubic foot of gassed slurry.

The mass transfer coefficient, $R_g a$, may then be maintained in the range 0.013 to 0.44 by adjusting the consistency, the superficial velocity and mixing energy to the gassed slurry according to the relationship $$K_g a = 0.374(0.103-0.112C_s)V_s^{0.48}[Pg/V]^{0.375}$$

when the consistency is in the range 0.15 to 0.68%.

The mass transfer coefficient may be maintained in the range of about 0.01 to about 0.013 by varying the same three variables according to the relationship $$K_g a = 0.34(0.0315-0.00643C_s)V_s^{0.48}[Pg/V]^{0.375}$$

when the consistency is in the range 0.68 to around 4.9%.

It is believed that these relationships are applicable to a number of fixed gases such as oxygen, ozone, chlorine, chlorine dioxide, chlorine monoxide, sulfur dioxide, and nitrogen dioxide.

BRIEF DESCRIPTION OF THE DRAWING

The drawing is a graph showing the relationship of consistency to mass transfer.

DETAILED DESCRIPTION OF THE PROCESS

Pulp is normally measured both for its degree of delignification and its strength.

The two normal methods of measuring the degree of delignification are the Kappa number and the PBC number. Both are variations of the permanganate test.

The normal permanganate test provides a permanganate number which is the number of cubic centimeters of tenth normal potassium permanganate solution consumed by one gram of oven dry pulp under specified conditions.

The Kappa number is similar to the permanganate number but is measured under carefully controlled conditions and corrected to be the equivalent of 50% consumption of the permanganate solution in contact with the specimen. It is able to give the degree of delignification of pulps through a wider range than does the permanganate number.

PBC is again a permanganate test, and is made as follows:

1. Slurry about 5 hand-squeezed grams of pulp stock in a 600-milliliter beaker and remove all shives.
2. Form a hand sheet in a 12.5-centimeter Buckner funnel, washing with an additional 500 milliliters of water. Remove the filter paper from pulp.
3. Dry the hand sheet for 5 minutes at 210°–220° F.
4. Remove the hand sheet and weigh 0.426 grams. The operation should be done in a constant time of about 45 seconds to ensure the moisture will be constant, since the dry pulp absorbs more moisture.
5. Slurry the weighed pulp sample in a 1-liter beaker containing 700 milliliters of 25° C. tap water.
6. Add 25 milliliters of 4 N sulphuric acid and 25 milliliters of 0.1000 N potassium permanganate. Start the timer at the start of the permanganate addition.
7. Stop the reaction after exactly 5 minutes by adding 10 milliliters of the 5% potassium iodide solution.
8. Titrate with 0.1000 N sodium thiosulfate. Add a starch indicator near the end of the titration when the solution becomes straw color. The end point is when the blue color disappears.

In running the test, the first part of the thiosulfate should be added as rapidly as possible to prevent the liberation of free iodine. The final part of the titration is completed drop wise until the blue color just disappears. The titration should be completed as rapidly as possible to prevent reversion of the solution from occurring.

The PBC number represents the pounds of chlorine needed to completely bleach one hundred pounds of air dried pulp at 20° C. in a single theoretical bleaching stage and equals the number of milliliters of potassium permanganate consumed as determined by subtracting the number of milliliters of thiosulfate consumed from the number of milliliters of potassium permanganate added. In the above test, the PBC number equals 25, the milliliters of potassium permanganate added, minus the milliliters of thiosulfate consumed. In the examples in this application, the PBC was determined after chemical treatment (Exit PBC).

Many variables affect the test, but the most important are the sample weight, the reaction temperature and the reaction time.

In some of the bleaching examples, the amount of chlorine added is expressed as a percent of PBC, that is a percent of the PBC number or a percent of the total pounds of chlorine needed to completely bleach the pulp at 20° C. in a single theoretical bleaching stage as determined by the PBC test.

In the present tests, pulp samples were beaten in a PFI machine for a specified number of revolutions (Rev.) and the freeness, density, burst factor, tear factor, and breaking length were determined. The freeness of the pulp, Canadian Standard Freeness (CSF), was determined by TAPPI Standard T 227 M-58, revised August 1958. The burst factor (Burst Fac.) is a numerical value obtained by dividing the bursting strength in grams per square centimeter by the basis weight of the sheet in grams per square meter and was determined by TAPPI Standard Test T 220 M-60, the 1960 Revised Tentative Standard. This test was also used to determine the tear factor. The tear factor (Tear Fac.) is a numerical value and equals 100 e/r when e is the force in grams to tear a single sheet, and r is the weight of the sheet per unit area in grams per square meter. Fold, breaking length in meters and density in grams per cubic centimeter were determined by TAPPI Standard Test T 220 OS-71; and opacity as a percent of a standard was determined by TAPPI Standard Test T 425 OS-75. Another factor is the strength factor-defined here as one percent of the product of the burst factor and the tear factor.

The definitions of other terminology found in the examples and tables are as follows:

Consistency: (Cons.) Amount of fiber in the slurry expressed as a percentage of the total weight of the oven dry fiber and solvent.

Amount charged: (Amt. Chg.) Amount of chemical charged to slurry expressed either as a percentage of the weight of the oven dry fiber in the slurry or as a volume in cubic centimeters.

Amount consumed: (Amt. Con.) Amount of chemical reacting with the fiber expressed as a percentage of the weight of the oven dry fiber in the slurry, determined by subtracting the amount of chemical still in slurry, the excess, from the amount charged to the slurry.

Excess: Amount of chemical that does not react with the fiber expressed as pounds per ton of oven dry fiber (1b/ODT).

Charge time: (Chg. time) Time in minutes or seconds required to charge ozone to the slurry.

Retention time: (Reten. time) Time in minutes or seconds that ozone is retained in contact with the slurry after charging.

Stir time: Time in minutes or seconds that slurry is mechanically agitated.

Flush time: Time in minutes or seconds that oxygen is bubbled through the slurry to erradicate any unreacted ozone after retention.

Total time: A summation in minutes or seconds of charge time, retention time, and flush time.

Initial pH: (Init. pH) In any stage, the pH of the slurry before adjustment with acid or alkali.

Adjusted pH: (Adjt. pH) In any stage, the pH of the slurry after addition of acid or alkali at the beginning of chemical treatment.

Exit pH: In any stage, the pH of the slurry after chemical treatment.

Buffer chemical: The acid or alkali used to adjust the pH of the pulp slurry.

Temperature: (Temp.) Temperature in °C. of the slurry at beginning of chemical treatment.

Brightness: (Bright.) The value of pulp brightness expressed as a percent of the maximum GE brightness as determined by TAPPI Standard Method TPD-103.

The brightness was determined either before (Init. Bright.) or after chemical treatment (Exit Bright.).

Viscosity: (Visc.) This value in centipoises (cP) was determined by TAPPI Standard Method T-230 SU-66. The value was determined either before (Init. Visc.) or after chemical treatment (Exit Visc.).

Yield: Yield may be measured in two ways. The first is on a weight basis, and is the measure of carbohydrates and lignin returned per unit of wood. Screened yield is closely related and proportional to this chemical return. A high screened yield means the chemical return is high and a low screened yield means the chemical return is low. The second measurement of yield is a fiber yield basis. Rejects or screenings are related to and inversely proportional to the fiber yield. A high reject level means there is a low fiber return and a low reject level means there is a high fiber return. The total yield is the sum of these two yields. The ideal situation would be one in which there is a high chemical return and a high fiber return indicated by a high screened yield and low screenings.

Kraft pulping process: The digestion or cooking of wood chips with sodium sulphate—a mixture of sodium hydroxide and sodium sulfite. The process conditions are well known in the industry.

Active alkali: The sum of all alkali hydroxide in solution expressed as $Na_2O$ including that formed by hydrolysis of the alkali sulfide, also expressed as $Na_2O$.

Soda pulping: The digestion or cooking of wood chips with sodium hydroxide. Again, the process conditions are well known in the industry.

Sulfidity: The total sodium sulfide as a percent of the total titratable alkali, all amounts being expressed as $Na_2O$. According to Vol. 1, *Pulp and Paper Manufacture*, Stephenson editor in chief, McGraw-Hill Book Company, Inc. 1950, Canadian mills consider sodium sulfide and sodium hydroxide to be the total titratable alkali and U.S. mills consider these two chemicals plus sodium carbonate to be the total titratable alkali. The latter definition is used in this application. The book also indicates that most soda mills use a cooking liquor having a sulfidity on the U.S. basis of approximately 5% or less, while in sulfide mills and draft mills the sulfidity is in excess of 15% and is often as much as 30%.

The following experiments were performed in a Waring blender. It was later determined that the horsepower being applied to the gassed slurry was 1 horsepower per cubic foot of gassed slurry. At these levels, the relationship between horsepower and mass transfer is not discernable.

EXAMPLES

Example 1: Douglas fir wood chips were pulped in the laboratory using the kraft process. The active alkali was 17% of the weight of the oven dry wood chips. It required 90 minutes to raise the charge to the cooking temperature of 171° C. The charge was cooked at that temperature for an additional 90 minutes. The pulp was separated from the cooking liquor and washed. The screened yield of the pulp was 43.75%, the screenings were 0.85%, and the total yield was 44.6%. The Kappa of the exiting pulp was 39.

Example 2: The pulp of Example 1, in a low-consistency alkaline slurry, was bleached with oxygen for 30 minutes at a temperature of 125° C. The liquor to pulp ratio was 15:1, a consistency of 6.67%; and the oxygen pressure was 100 psi. The amount of sodium hydroxide in the liquor was 4% of the weight of the oven dry pulp. A magnesium oxide protector was used. The pulp was separated from the liquor and washed. The exit PBC of the pulp was 3.02.

Example 3: A control was formed by bleaching the pulp from Example 2 using a DED sequence—chlorine dioxide, sodium hydroxide extraction, and chlorine dioxide.

First, the pulp from Example 2 was slurried with water to a consistency of 10% and bleached with chlorine dioxide. The amount of chlorine dioxide was equal to 2.2% of the weight of the oven dry pulp. Sodium hydroxide was also added to the slurry in an amount equal to 1.7% of the weight of the oven dry pulp. The treatment was for 180 minutes. The temperature was 70° C. The exit pH was 4. The pulp was separated from the bleach effluent and washed. The excess chlorine dioxide in the bleach effluent was 0.5 pounds per ton of oven dry pulp.

The pulp was then slurried with water to a consistency of 10% and extracted with sodium hydroxide. The amount of sodium hydroxide charged to the pulp slurry was equal to 0.75% of the weight of the oven dry pulp. The extraction was for a period of 60 minutes at 70° C. The exit pH was 11.0. The pulp was separated from the effluent and washed.

In the final stage the pulp was again slurried with water to a consistency of 10% and bleached with chlorine dioxide. Both chlorine dioxide and sodium hydroxide were charged to the pulp slurry. The chlorine dioxide was equal to 0.75% and the sodium hydroxide was equal to 0.35% of the weight of the oven dry pulp. The treatment was for 180 minutes at 70° C. The final pH was 3.48. The pulp was separated from the effluent and washed.

Stirring was used throughout all of the stages.

Example 4: Another control was run in which the process of Example 3 was repeated without stirring in any of the stages.

Examples 5–18: A series of experiments were run ozonating the pulp from Example 2 in a water slurry at consistencies ranging from 0.125% to 2%. In each of the examples 3,000 cc of water was used to slurry the pulp. The amount of oven dry pulp added to the water was 3.75 gm in Example 5, 7.5 gm in Example 6, 15 gm in Example 7, 30 gm in Examples 9–16, 45 gm in Example 17, and 60 gm in Example 18.

In Examples 5–10 and 17–18, the pH of the pulp slurry was adjusted with sulfur dioxide. The amount of sulfur dioxide used in each of these examples was 15.6 pounds per ton of oven dry pulp.

In Examples 11–16 the pH of the pulp slurry was adjusted with a combination of chlorine dioxide effluent and 0.1 N hydrochloric acid. The hydrochloric acid was added to simulate future mill conditions. It is thought that the amount of chlorine dioxide bleach effluent in a mill would be insufficient to totally adjust the pulp to the required pH. In Examples 11, 12 and 14, the effluent was a mill effluent taken from the excess sampling line of a chlorine dioxide tower. Its pH was 2.6, and it contained 2.5 pounds of chlorine dioxide per ton of oven dry pulp. In Examples 13, 15 and 16, the chlorine dioxide bleach effluent was squeezed from pulp after it had been bleached with chlorine dioxide in the laboratory. The pH of the effluent was 4.0, and it contained 1.2 pounds of chlorine dioxide per ton of oven dry pulp. The amount of chlorine dioxide effluent charged to the pulp per 30 grams of oven dry pulp was 500 cc in Example 11; 900 cc in Examples 12 and 13; and 300 cc in Examples 14–16.

In each of the examples, the amount of ozone charged to the pulp slurry was equal to 1.5% of the weight of the oven dry fiber. The ozone retention time was four minutes and the oxygen flush time was one minute. The temperature was 20° C.

Different stir times were used in Examples 14–16. In Example 14, the pulp slurry was stirred only for the first 30 seconds of retention time. In Example 15 the pulp slurry was stirred only for the first 30 seconds of retention time and the last 30 seconds of the oxygen flush time. In Example 16, the pulp slurry was stirred only for the first 30 seconds of the retention time and the first five seconds and last five seconds of the oxygen flush time.

After treatment the pulp was separated from the effluent and washed.

The other reaction conditions and results are given in Table I. These include the consistency, the adjusted pH, the ozone charge time, the total time, the amount of ozone consumed, the Exit PBC, the exit brightness and the exit viscosity.

TABLE I

| Ex. | Cons. % | Adjt. pH | Chg. Time Min. | Total Time Min. | Amt. Con. % | Exit PBC | Exit Bright. | Exit Visc. cP |
|---|---|---|---|---|---|---|---|---|
| 5 | 0.125 | 3.5 | 0.1125 | 5.1125 | 1.45 | 2.96 | — | — |
| 6 | 0.25 | 3.5 | 0.225 | 5.225 | 1.40 | 2.24 | — | — |
| 7 | 0.50 | 3.5 | 0.45 | 5.45 | 1.35 | 1.26 | 56.6 | 71.6 |
| 8 | 1.00 | 3.5 | 0.9 | 5.9 | 1.25 | 1.17 | 57.4 | 74.2 |
| 9 | 1.00 | 3.5 | 0.9 | 5.9 | 1.27 | 1.28 | 59.6 | 68.6 |
| 10 | 1.00 | 3.5 | 0.9 | 5.9 | 1.24 | 1.11 | — | — |
| 11 | 1.00 | 3.6 | 0.9 | 5.9 | 1.14 | 0.75 | — | — |
| 12 | 5.9 | 3.0 | 0.9 | 5.9 | 1.17 | 0.61 | — | — |
| 13 | 1.00 | 4.7 | 0.9 | 5.9 | 1.28 | 1.64 | — | — |
| 14 | 1.00 | 3.55 | 0.9 | 5.9 | 1.13 | 0.75 | — | — |
| 15 | 1.00 | 3.55 | 0.9 | 5.9;11 | 1.13 | 0.95 | — | — |
| 16 | 1.00 | 3.0 | 0.9 | 5.9 | 1.14 | 0.87 | — | — |
| 17 | 1.50 | 3.5 | 1.35 | 6.35 | 1.27 | 1.28 | — | — |
| 18 | 2.00 | 3.5 | 1.8 | 6.8 | 1.34 | 1.3 | 55.3 | 75.8 |

Examples 19–23: Certain of the pulps from the examples in Table I were further treated in a chlorine dioxide stage.

In each of these experiments, the pulp was slurried with water to a consistency of 10% and treated with chlorine dioxide. The amount of chlorine dioxide charged to the pulp slurry was equal to 1.75% of the weight of the oven dry pulp. Sodium hydroxide was used as a buffer. The amount of sodium hydroxide used was equal to 1.3% of the weight of the oven dry pulp. The bleaching treatment required 180 minutes at 70° C. After treatment, the pulp was separated from the bleaching effluent and washed. The initial brightness and viscosity of the pulp entering this stage, the excess chlorine dioxide expressed as pounds per ton of oven dry pulp, the exit pH, exit brightness, and exit viscosity of the pulp are given in Table II.

TABLE II

| Ex. | Pulp From Exp. | Init. Bright. | Init. Visc. | Excess Lb/ODT | Exit pH | Exit Bright. | Exit Visc. cP |
|---|---|---|---|---|---|---|---|
| 19 | 7 | 56.6 | 71.6 | 0.7 | 3.85 | 83.4 | 83.2 |
| 20 | 8 | 57.4 | 74.2 | 1.6 | 4.18 | 83.9 | 77.8 |
| 21 | 9 | 59.6 | 68.6 | 3.8 | 4.72 | 83.5 | 73.4 |
| 22 | 14 | | | 4.2 | 4.19 | 86.6 | 72.0 |
| 23 | 18 | 55.3 | 75.8 | 1.5 | 3.94 | 83.4 | 80.9 |

Example 24: The material from Example 10 was bleached in a hydrogen peroxide stage. The pulp was slurried with water to a consistency of 10%, and hydrogen peroxide equal to 1% of the weight of the oven dry pulp was charged to the slurry. The hydrogen peroxide contained sodium silicate equal to 2.5% and magnesium sulfate equal to 0.2% of the weight of the hydrogen peroxide. The peroxide was also buffered with sodium hydroxide. The amount of sodium hydroxide was 1% of the weight of the oven dry pulp. The treatment was for 150 minutes. The temperature was 40° C. The excess hydrogen peroxide was 11.2 pounds per ton of oven dry pulp. The final pH was 10.07; the final brightness, 74.6; and final viscosity, 73.6 centipoises.

The control pulps and the pulps from Table II and Example 24 were tested for strength. Table III is a comparison of the various pulps at 550 Canadian Standard Freeness. Table IV compares one pulp at four different Freenesses; and Table V compares two pulps at 400 Canadian Standard Freeness.

TABLE III

| Ex. | PFI CSF | Rev. | Density gm/cc | Burst Fac. | Tear Fac. | Fold | Breaking Length m | Opacity | Strength Factor |
|---|---|---|---|---|---|---|---|---|---|
| 3 | 550 | 3500 | 0.650 | 69 | 175 | — | 8700 | — | 12.075 |
| 4 | 550 | 4100 | 0.650 | 70 | 162 | — | 9700 | — | 11.340 |
| 19 | 550 | 3400 | 0.630 | 71 | 196 | — | 9400 | — | 13.916 |
| 20 | 550 | 3000 | 0.625 | 75 | 205 | — | 8800 | — | 15.375 |
| 21 | 550 | 3700 | 0.650 | 69 | 175 | 720 | 8900 | 61 | 12.075 |
| 22 | 550 | 3500 | 0.650 | 66 | 164 | — | 9000 | — | 10.824 |
| 23 | 550 | — | — | 78 | 183 | — | — | — | 14.274 |
| 24 | 550 | 3800 | 0.640 | 68 | 180 | — | 8200 | — | 12.240 |

TABLE IV

| Ex. | PFI CSF | Rev. | Density gm/cc | Burst Fac. | Tear Fac. | Fold | Breaking Length m | Opacity | Strength Factor |
|---|---|---|---|---|---|---|---|---|---|
| 21 | 739 | 0 | 0.496 | 26.3 | 280 | — | 8300 | 71 | 7.364 |
| | 550 | 3700 | 0.650 | 69 | 175 | 720 | 8900 | 61 | 12.075 |
| | 400 | 5300 | 0.670 | 73 | 163 | — | 9300 | 61 | 11.899 |
| | 250 | 7100 | 0.675 | 79 | 153 | — | 9500 | 61 | 12.087 |

TABLE V

| Ex. | PFI CSF | Rev. | Density gm/cc | Burst Fac. | Tear Fac. | Fold | Breaking Length m | Opacity | Strength Factor |
|---|---|---|---|---|---|---|---|---|---|
| 21 | 400 | 5300 | 0.670 | 73 | 163 | — | 9300 | 61 | 11.899 |
| 24 | 400 | 4200 | 0.640 | 78 | 183 | — | 9700 | — | 14.274 |

The invention was also tried using a soda pulp rather than a kraft pulp.

Example 25: Douglas fir chips were pulped with sodium hydroxide having a sulfidity of about 2%. They were then defibered and treated in a high-consistency oxygen stage following the teaching of Smith et al, U.S. Pat. No. 3,657,065. The exit Kappa of the pulp was between 32 and 33 and the exit PBC was 9.3.

Example 26: A control was run using the pulp from Example 25 followed by a CEHED sequence-chlorine, sodium hydroxide extraction, hypochlorite, a second sodium hydroxide extraction, and a final chlorine dioxide bleach.

In the chlorination stage, the pulp was slurried with water to a consistency of 3%, and bleached with chlorine for 25 minutes. The consistency of the pulp was 3%, and the initial temperature of the reaction was 25° C. Stirring was used throughout the reaction. The amount of chlorine charged to the pulp slurry was 70% of the total chlorine required to bleach the pulp as determined by the PBC test. The pulp was separated from the bleach effluent and washed. The excess chlorine in the bleach effluent was 0.3 pounds per ton of oven dry pulp. The exit pH was 1.8.

The pulp was slurried with water to a consistency of 10% and extracted with sodium hydroxide for 60 minutes at a temperature of 20° C. The amount of sodium hydroxide used was equal to 2.75% of the weight of the oven dry pulp. The exit pH was 11.9.

The pulp was separated from the extraction effluent, washed, slurried with water to a consistency of 10%, and bleached with hypochlorite. The amount of hypochlorite used was equal to 1.79% of the weight of the oven dry pulp. It was buffered with sodium hydroxide. The amount of sodium hydroxide used was equal to 0.45% of the weight of the oven dry pulp. The time of the reaction was 60 minutes. The temperature was 36° C. The exit pH was 10.05. The pulp was separated from the bleach effluent and washed. The excess hypochlorite in the bleach effluent was 1.3 pounds per ton of oven dry pulp.

The pulp was again slurried with water to a consistency of 10%, and extracted with sodium hydroxide. The amount of sodium hydroxide used was equal to 0.75% of the weight of the oven dry pulp. The extraction time was 60 minutes, and the temperature was 20° C. The exit pH was 11.35. The pulp was separated from the extraction effluent and washed.

The pulp was then slurried with water to a consistency of 10%, and bleached with chlorine dioxide. The amount of chlorine dioxide used was equal to 0.75% of the weight of the oven dry pulp. It was buffered with sodium hydroxide. The amount of sodium hydroxide used was equal to 0.3% of the weight of the oven dry pulp. The time of the reaction was 180 minutes. The temperature was 70° C. The pulp was separated from the bleach effluent and washed. The excess chlorine dioxide in the bleach effluent was 0.8 pounds per ton of oven dry pulp.

The slurry was stirred throughout each of these stages.

Examples 27–30: The pulp from Example 25 was slurried with water to a 1% consistency and bleached with ozone. In each of these examples, the pulp slurry was buffered to an adjusted pH of 3.5. In Example 27 the pH adjustment required 14.1 pounds of sulphur dioxide per oven dry ton of pulp. In Examples 28–30 the adjustment used 300 cc of chlorine dioxide mill bleach effluent per 30 grams of oven dry pulp and 0.1 N hydrochloric acid. The amount of chlorine dioxide in the effluent was 1.5 pounds per ton of oven dry pulp. In each of the experiments, after the retention time the ozone was flushed from the reactor with oxygen for a period of one minute. The slurry was stirred with a laboratory blender during the entire time. The temperature of the slurry was 20° C. Following treatment, the pulp was separated from the bleach effluent and washed.

Other conditions and the results of this treatment are given in Table VI.

TABLE VI

| | Ozone | | | | | | | |
|---|---|---|---|---|---|---|---|---|
| Ex. | Amt. Chg. % | Chg. Time min. | Reten. Time Min. | Total Time Min. | Amt. Con. % | Exit PBC | Exit Bright | Exit Visc. cP |
| 27 | 1.5 | 0.9 | 4.0 | 5.9 | 1.37 | 8.14 | — | 91.5 |
| 28 | 1.5 | 0.9 | 4.0 | 5.9 | 1.19 | 6.48 | 29.7 | 64.8 |
| 29 | 2.5 | 1.5 | 3.0 | 5.5 | 1.82 | 4.89 | 35.2 | 51.0 |
| 30 | 5.0 | 3.0 | 2.0 | 6.0 | 3.4 | 2.66 | — | 37.6 |

Examples 31–32: The pulps from Examples 28–29 were then given a bleaching treatment using a $C_DED$ bleach sequence-chlorine with chlorine dioxide, sodium hydroxide extraction, and chlorine dioxide.

Example 31: The material from Example 28 was slurried with water to a consistency of 3% and bleached with chlorine and chlorine dioxide in a single stage. The amount of chlorine charged to the pulp slurry was 60% of the total chlorine required to bleach the pulp as determined by the PBC test. The amount of chlorine dioxide was equal to 0.11% of the weight of the oven dry pulp. The time of the reaction was 25 minutes—20 minutes for the chlorine alone followed by 5 minutes for the chlorine and chlorine dioxide. The temperature was 20° C. The pulp was separated from the bleach effluent and washed. The excess chlorine dioxide in the bleach effluent was 0.8 pounds per ton of oven dry pulp. The exit pH was 2.1.

The pulp was slurried with water to a consistency of 10% and extracted with sodium hydroxide. The amount of sodium hydroxide was equal to 2.25% of the weight of the oven dry pulp. The time of the reaction was 60 minutes. The temperature was 70° C.

The pulp was separated from the extraction effluent, washed, slurried with water to a consistency of 10%, and bleached with chlorine dioxide. The amount of chlorine dioxide was equal to 1.9% of the weight of the oven dry pulp. Sodium hydroxide was used to buffer the solution. The amount of sodium hydroxide was equal to 1.4% of the weight of the oven dry pulp. The time of the reaction was 180 minutes, the temperature was 70° C. The pulp was separated from the bleach effluent and washed. The excess chlorine dioxide in the bleach effluent was 3.4 pounds per ton of oven dry pulp. The exit pH was 4.3.

The pulp had an exit brightness of 83.8 and an exit viscosity of 54.0. The pulp was tested at 550 CSF. The burst factor was 62; the tear factor, 170; the breaking length, 7900 meters; the revolutions, 2500; and the density 0.630 grams per cubic centimeter.

Example 32: The material from Example 29 was again slurried with water to a consistency of 3% and bleached with chlorine and chlorine dioxide. The amount of chlorine used was 55% of the total chlorine required to bleach the pulp as determined by the PBC test, and the amount of chlorine dioxide was equal to 2.2 pounds per ton of oven dry pulp. The time of the reaction was 25 minutes and the temperature was 70° C. The pulp was separated from the bleach effluent and washed. The excess chlorine dioxide in the bleach effluent was 1.1 pounds per ton of oven dry pulp. The final pH was 2.1.

The pulp was slurried with water to a consistency of 10% and extracted with sodium hydroxide. The amount of sodium hydroxide used was equal to 2.25% of the weight of the oven dry pulp. The time of the reaction was 60 minutes and the temperature was 70° C. The final pH was 11.7.

Following the extraction stage, the pulp was separated from the extraction effluent, slurried with water to a consistency of 10% and bleached with chlorine dioxide. The amount of chlorine dioxide was equal to 1.9% of the weight of oven dry pulp. Sodium hydroxide was used as a buffer. It was used in an amount equal to 1.4% of the weight of the oven dry pulp. The time of the reaction was 180 minutes, and the temperature was 70° C. The pulp was separated from the bleach effluent and washed. The excess chlorine dioxide in the effluent was 3.2 pounds per ton of oven dry pulp. The exit pH of the pulp was 4.22.

The pulp had an exit brightness of 85 and an exit viscosity of 44.6. The pulp was tested at 550 CSF. The burst factor was 66, the tear factor was 158, the breaking length was 7300 meters, the revolutions were 2100, and the density was 0.650 grams per cubic centimeter.

Example 33: The pulp from Example 30 was treated in a DED sequence—chlorine dioxide, sodium hydroxide extraction, and chlorine dioxide.

In the first stage of this sequence the pulp was slurried with water to a consistency of 10% and was bleached with chlorine dioxide. The amount of chlorine dioxide used was equal to 2.2% of the weight of the oven dry pulp. Sodium hydroxide was used to buffer the pulp slurry. The amount of sodium hydroxide used was equal to 1.7% of the weight of the oven dry pulp. The time of the reaction was 180 minutes and the temperature was 70° C. The final pH was 3.9. The pulp was separated from the bleach effluent and washed. The amount of excess chlorine dioxide in the effluent was 0.3 pounds per ton of oven dry pulp.

The pulp was slurried with water to a consistency of 10% and extracted with sodium hydroxide solution. The amount of sodium hydroxide used was equal to 0.75% of the weight of the oven dry pulp. The time of the extraction was 60 minutes, and the temperature was 70° C.

Following extraction, the pulp was separated from the extraction effluent, washed, slurried with water to a consistency of 10%, and bleached with chlorine dioxide. The amount of chlorine dioxide was equal to 0.75% of the weight of the oven dry pulp. Sodium hydroxide was used as a buffer. It was used in an amount equal to 0.35% of the weight of the oven dry pulp. The time of the reaction was 180 minutes and the temperature was 70° C. The pulp was separated from the bleach effluent and washed. The excess chlorine dioxide in the bleach effluent was 2.4 pounds per ton of oven dry pulp. The exit pH of the pulp was 4.6.

The pulp had an exit brightness of 87.7 and an exit viscosity of 31.5. The pulp was tested at 500 CSF. The burst factor was 57, the tear factor was 136, the breaking length was 7000 meters, the revolutions were 2100, and the density was 0.630 grams per cubic centimeter.

Example 34: A laboratory pulp was made using a soda cook followed by a low-consistency oxygen bleach, a low-consistency ozone bleach, and a final DED bleach sequence.

In the soda cook, the amount of sodium hydroxide charged to the pulp slurry equalled 23% of the weight of the oven dry chips. The liquor to wood ratio was 4:1. The sulfidity of the liquor was 2%. It required 90 minutes to raise the charge to the cooking temperature of 176° C. The chips were cooked for 90 minutes at that temperature. The pulp was separated from the effluent and washed. The screened yield was 43.8% and the screenings 3.8% for a total yield of 47.6%. The exit Kappa of the pulp was 72.

The liquor to pulp ratio in the low-consistency oxygen stage was 15:1. The oxygen pressure was 140 psi. The sodium hydroxide added to the pulp slurry equalled 10% of the weight of the oven dry pulp. An $MgCO_3$ protector was also added. It was equal to 2% of the weight of the oven dry pulp. The pulp was cooked for 60 minutes at a temperature of 115° C. after the charge was raised to that temperature. The pulp was separated from the effluent and washed. The exit Kappa was 14 and the exit PBC was 4.

In the low-consistency ozone stage, the pulp was slurried with water to a consistency of 1%. The amount of ozone charged to the pulp was equal to 1.75% of the weight of the oven dry pulp and the amount consumed was 1.5% of the weight of the oven dry pulp. 14.1 pounds of sulfur dioxide per ton of oven dry pulp were used to adjust the pH of the slurry to 3.5. The reaction time was 5 minutes. The temperature was 20° C. The pulp was separated from the bleach effluent and washed. The pulp had an exit PBC of 2.35; an exit brightness of 48.5; and an exit viscosity of 57.5 centipoises.

The pulp was slurried with water to a consistency of 10% and bleached with chlorine dioxide. The amount of chlorine dioxide charged to the pulp slurry was equal to 2.2% of the weight of the oven dry pulp. Sodium hydroxide was used as a buffer. The amount of sodium hydroxide charged to the pulp was equal to 1.7% of the weight of the oven dry pulp. The time of the reaction was 180 minutes. The temperature was 70° C. The exit pH was between 3 and 4. The pulp was separated from the bleach effluent and washed. The bleach effluent contained 1 pound of chlorine dioxide per ton of oven dry pulp.

The pulp was slurried with water to a consistency of 12% and extracted with sodium hydroxide. The amount of sodium hydroxide charged to the pulp slurry was equal to 0.75% of the weight of the oven dry pulp. The pulp was extracted for 60 minutes at a temperature of 70° C. The exit pH was 11.7.

The pulp was separated from the extraction effluent, washed, slurried with water to a consistency of 10% and bleached with chlorine dioxide. The amount of chlorine dioxide charged to the pulp slurry was equal to 0.75% of the weight of the oven dry pulp. Sodium hydroxide was used as a buffer. The amount of sodium hydroxide charged to the pulp slurry was equal to 0.35% of the weight of oven dry pulp. The pulp was treated for 180 minutes and the temperature was 70° C. The exit pH was 4.4. The pulp was separated from the bleach effluent and washed. There was 0.4 pounds of chlorine dioxide per ton of oven dry pulp in the bleach effluent.

Physical tests were made on these soda cook pulps at Canadian Standard Freenesses of 550 and 400. The results of these tests are given in Table VII.

TABLE VII

| Ex. | CSF | Rev. | Density gm/cc | Burst Fac. | Tear Fac. | Breaking Length m | Strength Factor |
|---|---|---|---|---|---|---|---|
| 26 | 550 | 3400 | 0.630 | 70 | 175 | 7400 | 12.250 |
| 31 | 550 | 2500 | 0.630 | 62 | 170 | 7900 | 10.540 |
| 32 | 550 | 2100 | 0.650 | 66 | 158 | 7300 | 10.428 |
| 33 | 550 | 2100 | 0.630 | 57 | 136 | 7000 | 7.752 |
| 34 | 550 | 2800 | 0.650 | 60 | 165 | 8200 | 9.900 |
| 26 | 400 | 4800 | 0.670 | 75 | 155 | 8500 | 11.625 |
| 31 | 400 | 3500 | 0.650 | 66 | 159 | 8700 | 10.494 |
| 32 | 400 | 2900 | 0.650 | 70 | 148 | 8100 | 10.360 |
| 33 | 400 | 2800 | 0.660 | 63 | 112 | 7800 | 7.056 |

Some of the samples were also tested at Canadian Standard Freenesses of around 750 and 250. These are given in Table VIII.

TABLE VIII

| Ex. | CSF | Rev. | Density gm/cc | Burst Fac. | Tear Fac. | Breaking Length m | Strength Factor |
|---|---|---|---|---|---|---|---|
| 26 | 766 | 0 | 0.502 | 23.4 | 209 | 2500 | 4.89 |
| 31 | 743 | 0 | 0.504 | 29.8 | 266 | 3400 | 7.93 |
| 32 | 746 | 0 | 0.539 | 30.3 | 288 | 3200 | 8.73 |
| 33 | 740 | 0 | 0.579 | 28.4 | 219 | 3300 | 6.22 |
| 26 | 250 | 6300 | 0.700 | 75 | 143 | 9200 | 10.725 |
| 31 | 250 | 4700 | 0.660 | 71 | 150 | 9300 | 10.650 |
| 32 | 250 | 4100 | 0.690 | 73 | 132 | 8700 | 9.636 |
| 33 | 250 | 3700 | 0.670 | 64 | 108 | 8200 | 6.912 |

Example 35: Douglas fir wood chips were pulped in the laboratory using the kraft process. The active alkali charged to the chips was 17% of the weight of the oven dry chips. The cooking temperature was 173° C. It required 90 minutes to raise the charge to the cooking temperature, and an additional 90 minutes to cook the chips at the cooking temperature. The pulp was separated from the effluent and washed. The screened yield was 42.0%; the screenings were 2.5%; and the total yield was 44.5%. The Kappa of the exiting pulp was 39.

The pulp was then bleached with oxygen. The ratio of liquor to pulp was 15:1. The oxygen pressure 140 psig. The amount of sodium hydroxide charged to the pulp slurry was equal to 4% of the weight of the oven dry pulp. The reaction was for 30 minutes at 125° C. after the charge was raised to that temperature. The pulp was separated from the effluent and washed.

Examples 36–56: The pulp from Example 35 was bleached at varying consistencies and times with varying amounts of ozone to determine certain of the process parameters. In each of these examples, the pulp slurry was buffered with 1.54 N nitric acid to adjust the pH. In Examples 36–50, the chamber was flushed with oxygen for one minute following the ozone retention time. In Examples 37–50 and 53–56, the temperature of the reaction was 20° C. In Examples 36 and 51, the temperature varied between 20° and 25° C., and in Example 52 the temperature varied between 20° and 49° C. In each of the examples, the experiment was performed in a laboratory Waring blender. There was stirring throughout the experiment in Examples 36–50 and 53–56. There was no stirring in Example 51 and 3 minutes stirring in Example 52. It was later calculated that the mixing energy of the blender was 1 hp per cubic foot of gassed reaction mixture.

The other conditions and results of these experiments are given in Table IX. These are the consistency of the pulp, the initial pH, the adjusted pH, the amount of ozone charged to the pulp as a percentage of the oven dry weight of the pulp, the charge time in seconds, the retention time in seconds or minutes, the total time in seconds or minutes, the amount of ozone consumed in grams and as a percentage of the oven dry weight of the pulp, the exit pH, PBC, brightness and viscosity.

TABLE IX

| | | | | Ozone | | | | | | | | | |
|---|---|---|---|---|---|---|---|---|---|---|---|---|---|
| Ex. | Cons. % | Init. pH | Adjt. pH | Amt. Chg. % | Chg. Time Sec. | Reten. Time Sec. | Total Time Sec. | Amt. Con. gm. | Amt. on Pulp % | Exit pH | Exit PBC | Exit Bright. | Exit Visc. cP |
| 36 | 0.125 | 8.5 | 3.5 | 1.5 | 6.75 | 281.25 | 348 | .043 | 1.15 | 2.74 | 0.96 | 64.6 | 53.7 |
| 37 | 0.25 | 8.5 | 3.5 | 1.5 | 13.5 | 274.5 | 348 | .09 | 1.19 | 3.03 | 0.83 | 67.3 | 51.7 |
| 38 | 0.5 | 8.5 | 3.5 | 1.5 | 27 | 261 | 348 | .172 | 1.15 | 2.93 | 0.82 | 67.7 | 54.7 |
| 39 | 1.0 | 8.5 | 3.5 | 1.5 | 54 | 234 | 348 | .322 | 1.07 | 2.85 | 0.89 | 64.2 | 56.9 |
| 40 | 2.0 | 8.5 | 3.5 | 1.5 | 108 | 180 | 348 | .569 | .94 | 2.75 | 1.18 | 61.2 | 55.9 |
| 41 | 1.0 | 8.5 | 3.5 | 0.75 | 30 | 93 | 180 | .172 | .57 | 2.91 | 1.67 | 53.3 | 78.0 |
| 42 | 1.0 | 8.5 | 3.5 | 1.0 | 36 | 84 | 180 | .210 | .70 | 2.89 | 1.41 | 57.2 | 72.9 |
| 43 | 1.0 | 8.5 | 3.5 | 1.25 | 45 | 75 | 180 | .245 | .82 | 2.84 | 1.15 | 61.1 | 67.1 |
| 44 | 1.0 | 8.5 | 3.5 | 1.5 | 54 | 60 | 180 | .277 | .92 | 2.91 | 1.08 | 61.9 | 64.0 |
| 45 | 0.25 | 7.7 | 3.5 | 1.5 | 13.5 | 106.5 | 180 | .0731 | .97 | | 0.96 | 63.2 | 61.3 |
| 46 | 0.5 | 8.5 | 3.5 | 1.5 | 27 | 93 | 180 | .140 | .93 | | 0.86 | 64.1 | 59.6 |
| 47 | 1.0 | 8.5 | 3.5 | 1.5 | 54 | 66 | 180 | .269 | .90 | | 0.98 | 61.3 | 62.5 |
| 48 | 1.0 | 8.5 | 3.0 | 1.0 | 36 | 84 | 180 | .213 | .71 | 2.33 | 1.22 | 57.0 | 72.7 |
| 49 | 1.0 | 8.5 | 5.0 | 1.0 | 36 | 84 | 180 | .235 | .78 | 4.08 | 1.59 | 55.2 | 65.2 |
| 50 | 1.0 | 8.5 | 7.0 | 1.0 | 36 | 84 | 180 | .239 | .80 | 5.9 | 1.77 | 50.9 | 73.7 |
| | | | | | | Min. | Min. | | | | | | |
| 51 | 1.0 | 8.5 | 3.0 | 1.0 | 36 | 3 | 3 | .250 | .83 | | 1.64 | 52.6 | 84.9 |

TABLE IX-continued

| Ex. | Cons. % | Init. pH | Adjt. pH | Ozone Amt. Chg. % | Ozone Chg. Time Sec. | Ozone Reten. Time Sec. | Ozone Total Time Sec. | Ozone Amt. Con. gm. | Ozone Amt. on Pulp % | Exit pH | Exit PBC | Exit Bright. | Exit Visc. cP |
|---|---|---|---|---|---|---|---|---|---|---|---|---|---|
| 52 | 1.0 | 8.5 | 3.0 | 1.0 | 36 | 15 | 15 | .247 | .82 | 3.2 | 1.29 | 55.7 | 76.1 |
| 53 | 1.0 | 8.5 | 3.0 | 1.0 | 36 | 15 | 15 | .234 | .78 | | 1.48 | 54.1 | 79.8 |
| 54 | 0.25 | 7.3 | 3.5 | 1.5 | 13.5 | 3 | 3 | .102 | 1.37 | 3.5 | 1.42 | 52.4 | 78.5 |
| 55 | 0.25 | 7.3 | 3.5 | 1.5 | 13.5 | 15 | 15 | .101 | 1.35 | 3.5 | 1.42 | 53.3 | 80.8 |
| 56 | 0.25 | 7.3 | 3.5 | 1.5 | 13.5 | 60 | 60 | .101 | 1.35 | 3.5 | 1.41 | 53.5 | 83.7 |

In another group of experiments, low-consistency and high-consistency ozonizations were compared. Both a single ozone stage and a sequence of ozone—extraction—ozone were used.

Example 57: Douglas fir wood chips were pulped in the laboratory using the kraft process. The active alkali was 17% of the weight of the oven dry wood chips. It required 90 minutes to raise the charge to the cooking temperature of 173° C. The chips were cooked at that temperature for 90 minutes. The pulp was then separated from the effluent and washed. The screened yield of the pulp was 41.9%, the screenings were 2.7%, and the total yield was 44.6%.

The pulp was slurried with water to a consistency of 6% and bleached with oxygen for 30 minutes at a temperature of 125° C. The oxygen pressure was 140 pounds per square inch. The liquor contained sodium hydroxide in an amount equal to 4% of the weight of the oven dry pulp. A magnesium oxide protector was used. The pulp was separated from the bleach effluent and washed. The exit PBC of the pulp was 3.1, the exit brightness was 40.6, and the exit viscosity was 187 centipoises.

Examples 58–63: The pulp from Example 57 was adjusted with 1.54 N nitric acid to a particular pH and air dried to 90% consistency. Thirty grams of the pulp, on an oven dry basis, was slurried with solvent to a particular consistency. The solvent had the same pH as the pulp. It was a mixture of water and filtrate from an ozone bleaching stage, after washing the ozonated pulp with 100 ml of water in a centrifuge. The pulp slurry was then treated with ozone. Both Examples 60 and 61 combined two 30-gram sample runs to provide a 60-gram sample. The pulp consistency, pH, ozone applied, ozone consumed, exit PBC, exit brightness, and exit viscosity are given in Table X.

TABLE X

| Ex. | Cons. % | pH | Ozone App. % | Ozone Con. % | Exit PBC % | Exit Bright. | Exit Visc. cP |
|---|---|---|---|---|---|---|---|
| 58 | 1 | 3 | 1.5 | 0.94 | 0.63 | 72.9 | 64.9 |
| 59 | 36 | 2.5 | 1.5 | 0.88 | 0.36 | 77.3 | 48.2 |
| 60 | 36 | 2.5 | 2.0 | 1.16 | — | 82.0 | 35.7 |
| 61 | 36 | 7.4 | 1.5 | 1.06 | — | 63.1 | 47.7 |
| 62 | 38 | 2.5 | 1.5 | 0.96 | 0.36 | 75.8 | 50.6 |
| 63 | 54 | 2.5 | 1.5 | 1.30 | 0.51 | 76.1 | 48.5 |

The physical properties of the pulp from Examples 57, 58, 60 and 61 were evaluated at 550 CSF. These are given in Table XI.

TABLE XI

| Ex. | Rev. | Density gm/cc | Burst Fac. | Tear Fac. | Breaking Length m | Strength Factor |
|---|---|---|---|---|---|---|
| 57 | 3500 | 0.670 | 72 | 147 | 9000 | 10.584 |
| 58 | 2000 | 0.680 | 70 | 138 | 9400 | 9.660 |

TABLE XI-continued

| Ex. | Rev. | Density gm/cc | Burst Fac. | Tear Fac. | Breaking Length m | Strength Factor |
|---|---|---|---|---|---|---|
| 60 | 3200 | 0.655 | 69 | 131 | 9300 | 9.039 |
| 61 | 3000 | 0.665 | 63 | 125 | 8000 | 7.875 |

As can be seen, the strength factor and viscosity of the treated low-consistency pulp is higher than that of the treated high-consistency pulp.

Examples 64–66: The pulp from Example 57 was also treated in a sequence of ozone—extraction—ozone at both low consistency and high consistency. The solvent used was the same as that used in Examples 58–63. The operating conditions for the ozone stages and the exit conditions of the pulp are given in the following table. The pulp was separated from the effluent and washed after each stage. The exit brightness and exit viscosity after the extraction stage in Example 64 was 72.3 and 72.5 respectively, and for Example 66 was 61.6 and 91.2 respectively. Table XII is directed to the first ozone stage; Table XIII is directed to the second ozone stage; Table XIV is directed to the overall ozone application; and Table XV is directed to the physical properties of the final pulp at 550 CSF.

TABLE XII

| Ex. | Cons. % | pH | Ozone App. % | Ozone Con. % | Exit Bright. | Exit Visc. cP |
|---|---|---|---|---|---|---|
| 64 | 1 | 3 | 1.0 | 0.75 | 66.9 | 80 |
| 65 | 38 | 2.5 | 1.0 | 0.81 | — | — |
| 66 | 38 | 2.5 | 0.5 | 0.42 | 57.0 | 97.8 |

TABLE XIII

| Ex. | Cons. % | pH | Ozone App. % | Ozone Con. % | Exit Bright. | Exit Visc. cP |
|---|---|---|---|---|---|---|
| 64 | 1 | 3 | 0.5 | 0.2 | 84.5 | 48.6 |
| 65 | 38 | 2.5 | 0.5 | 0.17 | 86.1 | 38.5 |
| 66 | 38 | 2.5 | 1.0 | 0.36 | 82.2 | 44.3 |

TABLE XIV

| Ex. | Cons. % | pH | Total Ozone App. % | Total Ozone Con. % | Exit Bright. | Exit Visc. cP |
|---|---|---|---|---|---|---|
| 64 | 1 | 3 | 1.5 | 0.95 | 84.5 | 44.6 |
| 65 | 38 | 2.5 | 1.5 | 0.99 | 86.1 | 38.5 |
| 66 | 38 | 2.5 | 1.5 | 0.78 | 82.2 | 44.3 |

TABLE XV

| Ex. | Rev. | Density gm/cc | Burst Fac. | Tear Fac. | Breaking Length m | Strength Factor |
|---|---|---|---|---|---|---|
| 64 | 1800 | 0.65 | 62 | 146 | 8600 | 9.052 |
| 65 | 3100 | 0.66 | 64 | 118 | 8900 | 7.552 |
| 66 | 3700 | 0.68 | 70 | 132 | 8800 | 9.240 |

From these experiments it can be seen that the strength factor and viscosity of the low-consistency pulp were greater than that of the high-consistency pulp having the same treatment-Example 65. When the treatment of the high-consistency pulp was charged to obtain strength properties equal to low-consistency pulp, the brightness of the high-consistency pulp was less than that of the low-consistency pulp.

Pilot plant experiments were also performed. The purpose of these experiments was to determine the design relations between superficial velocity, horsepower, consistency and mass transfer in the transfer of ozone from the gas to the fiber so that engineering of mill-scale equipment could proceed.

A number of new terms should be defined.

Mass Transfer Coefficient. The mass transfer coefficient, $K_g a$, accounts for the effect of the other operating variables on ozone removal. It is a function of stock consistency, Cs; specific power input, P/V; superficial gas velocity, $V_s$; reactor geometry; and to a lesser extent, temperature, viscosity, and surface tension. One of the important reasons for doing the pilot plant work was so that values of $K_g a$ could be determined at a variety of different operating conditions.

The mass transfer coefficient is determined from pilot plant data using the following formula $$K_g a \frac{\text{lb mol } O_3}{\text{hr Atm ft}^3} = \frac{M\ (\text{lb mol } O_2/\text{hr})\ w\ (\text{lb mol } O_3/\text{lb mol } O_2)}{V_d(\text{ft}^3)\ PO_3eg\ (\text{Atm})}$$

in which $K_g a$ is the mass transfer coefficient; M is the molar flow rate of oxygen; w is the moles of ozone transferred per mole of oxygen; $V_d$ is the volume of both stock and dispersal gas in the reactor; and $PO_3eg$ is the partial pressure of ozone in the exit gas of the reactor.

This equation does not include the partial pressure of ozone in equilibrium with the bulk liquid. However, in the operating range under discussion, the ozone is in vanishingly small quantities in the liquid because the limiting condition is the transfer of ozone from the gas to the liquid. Certain experiments were performed and showed that the amount of ozone in the liquid was undetectable.

Superficial Gas Velocity. This is the speed at which the gas would pass up through the reactor if the tank were empty.

Specific Power Input. This is the amount of power supplied to the reactor per unit volume of the reaction mixture. This is not the same as the horsepower of the motor turning the impeller. It is less because of energy losses, such as friction losses, within the system.

Calculations were also made to determine if the reactor height and diameter ratio had any effect on the mass transfer coefficient. The data indicated that this ratio did not affect the mass transfer coefficient. Calculations were also made to determine if the ratio of the impeller diameter to the tank diameter had any effect on the mass transfer coefficient, and again it was found that there was no effect, at constant power inputs.

The following data does not include all of the pilot plant experiments. The following examples are exemplary and were used for determining the relationships of the various factors.

TABLE XVI

| Ex. | Cons. % | Vc ft/hr | $Pg/V_3$ $Hp/ft^3$ | Kga |
|---|---|---|---|---|
| 67 | 0.72 | 116.5 | .0244 | .03949 |
| 68 | 0.39 | 496.6 | .0 | .03285 |
| 69 | 0.39 | 496.6 | .02793 | .1088 |
| 70 | 0.39 | 496.6 | .003305 | .0561 |
| 71 | 0.27 | 798.5 | .0 | .04148 |
| 72 | 0.27 | 798.5 | .01500 | .1700 |
| 73 | 0.27 | 798.5 | .002684 | .06906 |
| 74 | 0.51 | 499.1 | .09299 | .1125 |
| 75 | 0.51 | 1389.0 | .0 | .02531 |
| 76 | 0.51 | 1389.0 | .06801 | .1769 |
| 77 | 1.4 | 303.6 | .001637 | .002183 |
| 78 | 1.4 | 303.6 | .007491 | .01914 |
| 79 | 1.4 | 303.6 | .03241 | .04022 |
| 80 | 1.4 | 609.7 | .02567 | .04768 |
| 81 | 1.4 | 609.7 | .005467 | .002918 |
| 82 | 1.4 | 609.7 | .001020 | .000797 |
| 83 | 0.65 | 305.3 | .001206 | .01385 |
| 84 | 0.65 | 305.3 | .003127 | .02824 |
| 85 | 0.65 | 305.3 | .03605 | .05448 |
| 86 | 0.65 | 644.7 | .002570 | .01927 |
| 87 | 0.65 | 644.7 | .007276 | .03544 |
| 88 | 0.65 | 644.7 | .02979 | .06567 |
| 89 | 0.25 | 306.1 | .0008027 | .03619 |
| 90 | 0.25 | 306.1 | .00886 | .06866 |
| 91 | 0.25 | 306.1 | .03393 | .09618 |
| 92 | 0.25 | 653.0 | .02832 | .1196 |
| 93 | 0.15 | 306.1 | .007275 | .07291 |
| 94 | 0.15 | 306.1 | .0006392 | .03131 |
| 95 | 0.15 | 306.1 | .03202 | .1509 |
| 96 | 0.15 | 134.8 | .001251 | .03140 |
| 97 | 0.15 | 134.8 | .04240 | .09982 |
| 98 | 0.15 | 134.8 | .01186 | .06974 |
| 99 | 0.15 | 134.8 | .2516 | .1386 |

This information was then used to determine mass transfer coefficient vs. consistency as shown in the FIGURE. For this FIGURE, the information on Table XVI was corrected so that all the mass transfer coefficients were determined on the basis of a power of 0.01 horsepower per cubic foot and a superficial velocity of 305 feet per hour. From the graph it may be seen that there is a definite break in the slope of the mass transfer coefficient at 0.68% consistency.

A typical formula for a mass transfer coefficient is $$K_g a = K V_s^d P_g^e$$

However, from the pilot plant data it is possible to derive a specific formula for the mass transfer coefficient of a gaseous chemical in terms of the consistency of the fiber in the slurry, the superficial velocity of the gas, and the mixing energy, or power dissipated into the gassed slurry. These equations are for softwood fibers. The ranges for the superficial velocity are 100–1,400 feet per hour and for the mixing energy, 0.006 to 0.1 horsepower per cubic foot of gassed slurry. The relative change in the volume of the gaseous chemical should be small. The way of achieving this is to place the gaseous chemical in a carrier gas and maintain its percentage in the total return of carrier gas and chemical at a low level. This level would usually be less than 25% of the total return and preferably less than 10% of the total volume.

In the consistency range of 0.15 to 0.68%, the equation is $$K_g a = 0.374(0.103-0.112C_s)V_s^{0.48}[Pg/V]^{0.375}$$

and in the consistency range 0.68 to 4.9%, the equation is $$K_g a = 0.34(0.0315-0.00643C_s)V_s^{0.48}[Pg/V]^{0.375}$$

These equations may be used for gases other than ozone. For example, the equations would also hold true for fixed gases such as oxygen, chlorine, chlorine dioxide, chlorine monoxide, sulfur dioxide, and nitrogen dioxide.

It is now possible to maintain the mass transfer coefficient in the range 0.13 to 0.44 when the consistency is between 0.15 and 0.68% by varying the consistency, superficial gas velocity and power to the gassed slurry according to the relationship $$K_g a = 0.374(0.103-0.112C_s)V_s^{0.48}[Pg/V]^{0.375}$$

The mass transfer coefficient can also be maintained within the range 0.01 to 0.013 when the consistency is between 0.68 and 4.9% by varying the consistency, superficial gas velocity and power to the gassed slurry according to the relationship $$K_g a = 0.34(0.0315-0.00643C_s)V_s^{0.48}[Pg/V]^{0.375}$$

In both of these relationships, either the superficial gas velocity is in the range 100 to 1,400 feet per hour, or the mixing energy is in the range 0.006 to 0.1 horsepower per cubic foot of gassed slurry.

Although the optimum consistency is 0.18%, it should be understood that there are many practical difficulties in attempting to dewater a slurry of this low consistency and a slurry of 0.3% is more easily dewatered. It should also be understood that there are many trade-offs between capital costs, number of stages, and the superficial velocity, the power and the consistency. In one proposal for a 500-ton-per-day bleach plant the consistency was maintained at 0.39%, the mixing energy was 0.0208 horsepower per cubic foot of gassed slurry, and the superficial gas velocity was 870 feet per hour. The tanks were baffled in a standard manner.

We also determined the limiting factors in the reaction and how these could be controlled with the mixing energy. In the reactor, the possible rate limiting steps were diffusion from the bulk gas to the bubble surface, the bubble surface to the bulk liquid, and the bulk liquid to the fiber surface. If all of these processes were rapid enough, then the chemical rate of reaction would limit the overall rate of ozone removal.

A brief examination of the pilot plant results made it immediately obvious that in the range of the operating conditions, the overall removal rate of ozone was not limited by the chemical rate of reaction. A stock slurry of 3 PBC pulp in fresh water requires approximately a one weight percent dosage of ozone to obtain a drop of one unit in PBC. This was roughly the dosage in the pilot plant and yet only 5 to 40% of the charge was consumed. We had found that the ozone-lignin reaction is extremely fast. Therefore it must be assumed that the transport of ozone to the fiber, and not the chemical kinetics, limits the overall removal rate of ozone. A test for dissolved ozone was made by drawing a sample from the reactor into a vacuum bottle which contained a 20 weight percent solution of potassium iodide. Immediately upon contact with this solution, the dissolved ozone reacts with the potassium iodide and is therefore no longer available to react with lignin in the fiber. The vacuum bottle was also connected to an aspirator which pulled off ozone gas bubbles in the slurry as it entered the bottle, thus ensuring that only dissolved ozone could react with the potassium iodide solution. Once the sample has been taken, it was titrated with sodium thiosulfate to determine how much ozone has reacted with the potassium iodide.

This test was used to determine if chemical kinetics was a limiting factor. If chemical kinetics were the slowest step, the ozone would be passed to the fiber more quickly than it could be consumed, resulting in the water surrounding the fiber becoming saturated with ozone. At specific powers below 0.4 horsepower per cubic foot of gassed slurry, the water surrounding the fiber has little or no dissolved ozone showing that chemical kinetics is not limiting.

We also ruled out the possibility that the diffusion of ozone from the bulk gas in the bubble to the bubble surface was limiting the overall rate of its removal. In this series of experiments, the ozone-oxygen gas was passed up through either water of a 1.0% consistency stock slurry in which a large amount of potassium iodide was dissolved. The highly reactive potassium iodide assured that there would be no dissolved ozone in the bulk liquid around the gas bubbles. If the concentration of potassium iodide was high enough, the potassium iodide would diffuse through the stagnant liquid layer around the bubble fast enough to react with ozone right at the bubble surface and make the ozone concentration equal to zero there also. By making the ozone concentration equal to zero everywhere except at the bubble surface, all sources of resistance to the passage of ozone to the fiber surface were eliminated except for one, the transport of ozone from the bulk gas to the bubble surface. If, at high impeller power input and with a high concentration of dissolved potassium iodide, the removal of ozone had still been poor, then it could have been concluded that it was this step that limited the overall removal rate. If, on the other hand, at lower impeller power input, all the ozone was removed, it could be assumed that diffusion through the stagnant gas layer could not possibly limit the overall rate of ozone removal.

In three runs the ozone was almost completely removed even with no mixing. Therefore, in our reactor, the transport of ozone from the bulk gas to the bubble surface did not limit its overall removal rate.

After completely analyzing the pilot plant data, we have determined that either of the remaining transport steps can limit the removal of ozone. If all operating conditions except impeller power input are kept constant, the step that limits the removal of ozone will shift. At lower impeller speeds, the passage of ozone from bubble surface to the bulk liquid is the rate controlling step. However, as power input is increased to very high levels, the diffusion of ozone through the stagnant layer around the fiber begins to control removal rate. This is because at lower impeller speeds the bubbles passing up through the reactor are much larger than at high speeds. A large bubble has more volume per surface area, which makes it more difficult for the ozone to pass from the bubble into the bulk liquid. Therefore, at lower impeller power input, it is the transport of ozone from the bubble surface to the bulk liquid that limits the ozone removal rate. As impeller speed increases, the bubbles get smaller and the transport of ozone into the bulk liquid gets faster. Eventually, when enough power is applied, the ozone starts passing into the bulk liquid more quickly than it can diffuse through the layer around the fiber. At this point the rate controlling step begins to shift and dissolved ozone can be detected in the bulk liquid around the fiber. The system was tried at three mixing energies and the liquid was analyzed for ozone. The results are:

TABLE XVII

| Ex | Gassed Power (HP/ft$^3$ gassed slurry) | $O_3$ Concentration $\times 10^4$ (Gram moles/liter) |
|---|---|---|
| 100 | 0.453 | 1.30 |
| 101 | 0.418 | 0.10 |
| 102 | 0.243 | 0.03 |

From this it appears that below about 0.2 horsepower per cubic foot of gassed slurry all ozone transferred to the liquid phase from the gas phase will immediately transfer to the fiber or solid phase, and that transfer from the gas to liquid phase is the limiting factor in the reaction. Between about 0.2 and 0.4 horsepower per cubic foot of gassed slurry there is a transition zone in which both interfaces are limiting. Above 0.4 horsepower per cubic foot of gassed slurry the limiting factor is the transfer of the ozone from the liquid to the solid phase.

It should also be understood that there is a practical limitation to the amount of brightening that can be done in an ozone stage. Consequently, some of the earlier stages must bring the brightness up to a level which can be treated by ozone or additional brightening stages must occur after the ozone treatment to bring the brightness to an appropriate level. For this reason an oxygen bleaching sequence is normally thought to be required prior to the ozone treatment. The amount of brightening will depend on the pulping stage, kraft pulping creating a brighter pulp than soda pulping. If the ozone treatment does not increase the brightness to an appropriate amount, then follow-on brightening stages such as the use of chlorine dioxide, hydrogen peroxide, or a combination process such as chlorine dioxide, extraction, chlorine dioxide or an extraction followed by a second ozone treatment could be used.

In the present claims the "mixing energy" is the actual energy or horsepower applied directly to the gassed slurry and does not indicate the horsepower of the motor being used.

The water will include impurities from the brightening of the cellulosic fibers as the reaction continues. Should the water be recycled to another ozone treatment, then the water will initially include these impurities. The term "water" as used in the claims would include either of these conditions.

Hutchinson U.S. Pat. No. 4,012,280, issued Mar. 10, 1977; Kenig U.S. Pat. No. 3,888,727, issued June 10, 1975; Sjostrom West German Pat. No. 2,610,891, having a patent date of Sept. 9, 1976; and Fiehn East German Patent No. 98549, having an issue date of June 20, 1973 disclose various additives that may be used in a pulping process, and the term "additives" as used in the present claims includes such additives as well as additives contributing to sulfidity.

What is claimed is:

1. The process of bleaching cellulosic fibers comprising:

forming a slurry by placing said cellulosic fibers in a solvent consisting essentially of water having an initial pH of 2 to 8, said fibers being present in said slurry in an amount in the range of 0.017 to about 0.7%, on an oven-dry basis, of the total ungassed weight of said slurry;

charging an ozone bearing gas to said slurry, said ozone being present in an amount equal to 0.05 to 23% of the total weight of said ozone bearing gas;

mixing said slurry and said gas using a mixing energy of 0.002 to 0.4 horsepower per cubic foot of gassed slurry wherein the transfer of ozone through the gas-liquid interface is facilitated.

2. The process of claim 1 in which said cellulosic fibers are present in an amount in a range of 0.15 to about 0.7% of the total ungassed weight of said slurry.

3. The process of claim 2 in which said cellulosic fibers are present in an amount in a range of 0.3 to about 0.7% of the total ungassed weight of said slurry.

4. The process of claim 1 in which said cellulosic fibers comprise wood pulp fibers.

5. The process of claim 4 in which said wood pulp fibers comprise mechanical wood pulp fibers.

6. The process of claim 4 in which said wood pulp fibers comprise chemical wood pulp fibers.

7. The process of claim 6 in which said chemical wood pulp fibers comprise sulfate wood pulp fibers.

8. The process of claim 6 in which said chemical wood pulp fibers comprise sulfite wood pulp fibers.

9. The process of claim 6 in which said chemical wood pulp fibers comprise soda wood pulp fibers.

10. The process of claim 1 further comprising said ozone bearing gas having a superficial gas velocity in the range of 200 to 3,800 feet per hour.

11. The process of claim 10 in which said superficial gas velocity is in the range of 200 to 1,400 feet per hour.

12. The process of claim 1 further comprising said ozone being present in an amount equal to 0.05 to 6% of the total weight of said ozone bearing gas.

13. The process of bleaching cellulosic fibers comprising:

forming a slurry by placing said cellulosic fibers in a solvent consisting essentially of water having an initial pH of 2 to 8, said fibers being present in said slurry in an amount in the range of 0.017 to about 0.7%, on an oven-dry basis, of the total ungassed weight of said slurry;

charging an ozone bearing gas to said slurry, said ozone being present in an amount equal to 0.05 to 23% of the total weight of said ozone bearing gas, and mixing said slurry and said gas using a mixing energy of 0.2 to 1.0 horsepower per cubic foot of gassed slurry wherein the transfer of ozone through the liquid-solid interface is facilitated.

14. The process of claim 13 in which said cellulosic fibers are present in an amount in a range of 0.15 to about 0.7% of the total ungassed weight of said slurry.

15. The process of claim 14 in which said cellulosic fibers are present in an amount in a range of 0.3 to about 0.7% of the total ungassed weight of said slurry.

16. The process of claim 13 in which said cellulosic fibers comprise wood pulp fibers.

17. The process of claim 16 in which said wood pulp fibers comprise mechanical wood pulp fibers.

18. The process of claim 16 in which said wood pulp fibers comprise chemical wood pulp fibers.

19. The process of claim 18 in which said chemical wood pulp fibers comprise sulfate wood pulp fibers.

20. The process of claim 18 in which said chemical wood pulp fibers comprise sulfite wood pulp fibers.

21. The process of claim 18 in which said chemical wood pulp fibers comprise soda wood pulp fibers.

22. The process of bleaching cellulosic fibers comprising:

forming a slurry by placing said cellulosic fibers in a solvent consisting essentially of water having an initial pH in a range of 2.0 to 8, said cellulosic fibers being present in said slurry in an amount in a range of 0.017 to about 0.7%, on an oven-dry basis, of the total ungassed weight of said slurry;

charging an ozone bearing gas to said slurry, said ozone being present in an amount equal to 0.05 to 23% of the total weight of said ozone bearing gas;

mixing said slurry and said gas using a mixing energy in the slurry in a range of 0.002 to 0.2 horsepower per cubic foot of gassed slurry wherein the transfer of said ozone through the gas-liquid interface is facilited; and separating said cellulosic fibers from said slurry.

23. The process of claim 22 in which said cellulosic fibers are present in an amount in a range of 0.15 to about 0.7% of the total ungassed weight of said slurry.

24. The process of claim 23 in which said cellulosic fibers are present in an amount in a range of 0.3 to about 0.7% of the total ungassed weight of said slurry.

25. The process of claim 22 further comprising:

said ozone bearing gas having a superficial velocity through said slurry in the range of 200 to 3,800 feet per hour.

26. The process of claim 25 in which said ozone bearing gas has a superficial velocity through the slurry in the range of 200 to 1,400 feet per hour.

27. The process of claim 22 further comprising:

said ozone being present in an amount equal to 0.05 to 6% of the total weight of said ozone bearing gas.

28. The process of claim 22 in which said cellulosic fibers are wood pulp fibers.

29. The process of claim 28 in which said wood pulp fibers comprise mechanical wood pulp fibers.

30. The process of claim 28 in which said wood pulp fibers are chemical wood pulp fibers.

31. The process of claim 30 further comprising forming said chemical wood pulp fibers by cooking wood chips in a sulfate process.

32. The process of claim 30 further comprising forming said chemical wood pulp fibers by cooking wood chips in a sulfite process.

33. The process of claim 30 further comprising forming said chemical wood pulp fibers by cooking wood chips in a soda process.

34. The process of claim 30 further comprising:

bleaching said chemical wood pulp fibers with oxygen prior to forming said slurry.

35. The process of claim 34 in which said oxygen bleach reduces the Kappa of said chemical wood pulp fibers below 16 after said oxygen treatment.

36. The process of claim 35 in which said ozone treatment reduces the Kappa of said chemical wood pulp fibers to a range of 1 to 5 after said ozone treatment.

37. The process of claim 30 further comprising:

treating said chemical wood pulp fibers with additional bleaching chemical after said ozone treatment.

38. The process of claim 37 in which said additional bleaching chemical is chlorine dioxide.

39. The process of claim 38 further comprising:

treating said chemical wood pulp fibers with an extraction chemical and then a bleaching chemical after said chlorine dioxide treatment.

40. The process of claim 37 in which said additional bleaching chemical is hydrogen peroxide.

41. The process of claim 30 further comprising:

treating said chemical wood pulp fibers with an extraction chemical and a bleaching chemical after said ozone treatment.

42. The process of claim 41 in which said bleaching chemical is ozone.

43. The process of claim 22 in which said ozone is charged in an amount and range of 0.5 to 5% of the oven dry weight of said cellulosic fibers in said slurry.

44. The process of claim 22 further comprising:

treating said cellulosic fibers with additional bleaching chemical after said ozone treatment.

45. The process of claim 44 in which said additional bleaching chemical is chlorine dioxide.

46. The process of claim 45 further comprising:

treating said cellulosic fibers with an extraction chemical and then a bleaching chemical after said chlorine dioxide treatment.

47. The process of claim 44 in which said additional bleaching chemical is hydrogen peroxide.

48. The process of claim 22 further comprising:

treating said chemical wood pulp fiber with an extraction chemical and a bleaching chemical after said ozone treatment.

49. The process of claim 48 in which said bleaching chemical is ozone.

* * * * *